United States Patent [19]

Kendziorski

[11] Patent Number: 4,488,585

[45] Date of Patent: Dec. 18, 1984

[54] FIREWOOD QUARTERING SPLITTER WEDGE

[76] Inventor: John F. Kendziorski, 49756 York Rd., Adena, Ohio 43901

[21] Appl. No.: 499,558

[22] Filed: May 31, 1983

[51] Int. Cl.[3] ..... B27L 7/00

[52] U.S. Cl. ..... 144/193 D; 254/104

[58] Field of Search ..... 254/104; 145/2 R; 144/193 R, 193 C, 193 D

[56] References Cited

U.S. PATENT DOCUMENTS

| | | | |
|---|---|---|---|
| 2,286,586 | 6/1942 | Starks | 254/104 |
| 4,175,601 | 11/1979 | Meyer | 144/193 D X |
| 4,209,046 | 6/1980 | Lauigne | 144/193 D |

FOREIGN PATENT DOCUMENTS

| | | | |
|---|---|---|---|
| 185266 | 4/1956 | Austria | 144/193 D |
| 603135 | 6/1948 | United Kingdom | 144/193 D |

*Primary Examiner*—W. D. Bray

*Attorney, Agent, or Firm*—Frease & Bishop

[57] ABSTRACT

A firewood splitting wedge tool for splitting quarters at one time from a log. The tool is formed integrally of metal with a cross-shaped cross section formed by four wedge blades each having the same wedge taper extending from a flat cross-shaped top surface downward to sharp lower blade edges. The blade edges are tapered slightly outwardly downwardly from the axial central body portion of the tool where the four blades join located at 90° angles between each blade and its adjacent blades. The arrangement provides two primary coplanar blades and two secondary coplanar blades located normal to the primary coplanar blades, the latter being longer than the secondary coplanar blades. A wide flat curved sharp edged starter portion extends downwardly from the sharp angled lower ends of the primary blades.

1 Claim, 4 Drawing Figures

FIREWOOD QUARTERING SPLITTER WEDGE

BACKGROUND OF THE INVENTION

1. Field of the Invention

The invention relates to an integral metal firewood splitting wedge or tool that may be used readily with a sledgehammer in splitting firewood. More particularly, the invention relates to a metal splitting tool which may be used at one time to split logs or billets of wood of all types, kinds and different hardnesses into generally uniform quarters more rapidly and easily than similar logs may be split into quarters using the long known and traditional single wedge.

Further, the quarters thus split at one time ordinarily are more uniform for easy stacking than quarters split using a traditional single wedge.

In addition, the invention relates to a metal quartering wood splitter which may be relatively easily and rapidly driven to split say 2-foot long logs, for example, having diameters of from 10 or 12 inches to say 20 or more inches, two to three times faster than similar logs or billets may be split with the traditional single blade splitting wedge.

Also, the invention relates to a new quartering splitting wedge construction which I have discovered does not become stuck in the log during splitting, and does not tend to fly out during sledge-driving, thus reducing the likelihood of injury to the user.

Finally, the invention relates to a new integral metal quartering splitter wedge or tool which is characterized by having all of the features described.

2. Description of the Prior Art

Many types and kinds of splitting wedges are known which have been used for splitting firewood logs or billets usually in 2-foot lengths and preferably in quarters.

The traditional single wide blade wedge is somewhat difficult to drive into certain types of hard and dense woods. Sometimes in splitting larger diameter logs, the traditional single wedge may become stuck in attempting to make the initial split into halves. Further, it is very difficult to position and hold a half-split piece while attempting to drive a single wedge to again split the half-split piece. Frequently, the half-split piece upsets, or the wedge flies out in attempting to start the split. In any event, quarter splitting of large logs or billets is a difficult, tedious and time-consuming task.

The prior art contains examples of four winged or bladed splitters intended for use in quarter splitting wood logs, examples of which are U.S. Pat. Nos. 4,175,601, 4,209,046 and 2,286,586.

The wedge tool of U.S. Pat. No. 4,175,601 has four tapered wedge blades extending substantially 90° apart and the blades have knife edges angled upwardly outwardly from the same axial location around a projecting conically pointed starter. It has been found that this type of tool is difficult to start. All four blades must simultaneously enter the wood in the center of the billet, which presents great resistance to such starting and driving. The wood may tend to split in half.

U.S. Pat. No. 4,209,046 essentially illustrates a typical traditional wide blade wide-tapered wedge having two thin, flat lateral wings extending from the main full width wedge, and having outwardly downwardly angled knife edges. Such thin wing blades are relatively weak as compared with the main full width wedge body and may not stand the abuse of sledgehammer driving and may become bent or torn from the main wedge. The tool has no starter portion and nothing to assist in stabilizing the initial driving of the tool during wedge entry resistance.

U.S. Pat. No. 2,286,586 shows several forms of cross wedges each form being fundamentally the same as the construction in U.S. Pat. No. 4,209,046. That is, the tool has a main full width wide angled traditional wedge shape from which narrow substantially flat wings extend at each side at right angles to the main wedge body. All four knife edges must be started and enter the log or billet being split at the same time. This is a most difficult task to initiate wedge entry and avoid wedge fly-out during the initial sledgehammer blows, even more difficult than normally is involved using the traditional single wedge.

Accordingly, there has been an existing need in the art for a reliable quartering wedge for splitting firewood which may be readily entered and easily and safely driven to provide split quarters from logs of many sizes, more rapidly than such logs may be split using the traditional wedge.

SUMMARY OF THE INVENTION

Objectives of the invention include providing an integral metal quartering splitter wedge tool for splitting firewood having a generally right angled cross-shape in section, formed of four wedge blades having substantially the same uniformly tapered wedge shape integrally centrally connected together at the tool axis and extending upward from their lower sharp wedge edge; providing such quartering tool with a tapered preferably laterally rounded sharp knife edge starter portion extending downward from the sharp edges of two coplanar primary wedge blades; providing such quartering tool cross-shape by locating two secondary coplanar wedge blades in positions extending laterally normally outward from the central axially extending body portion of said primary coplanar wedge blades; providing such quartering tools' primary and secondary wedge blades with their sharp wedge edges formed to extend angularly outwardly downwardly from the axial central body portion and with the sharp wedge edges of the primary blades located spaced axially downward from the location of the sharp wedge edges of the secondary blades; and providing said new integral metal cross-shaped four-bladed rugged quatering tool construction so that the tool may be used to reliably, safely, effectively and efficiently quarter logs or billets, thereby overcoming difficulties encountered with prior art devices and satisfying a long-standing want in the art.

These and other objects and advantages may be obtained by the construction stated in general terms as an integral metal tool for quarter splitting wood logs, billets and the like, including a body cross-shaped in cross section formed by four similarly tapered wedge blades joined at an axially extending central body portion from which each blade projects outward at right angles to its two adjacent blades; two of said blades being coplanar primary blades, and the other two blades being coplanar secondary blades one of which projects normally outward from each side of said primary blades; all said blades having lower sharp ends extending angularly outwardly downwardly from said central axial body portion; the lower sharp angularly extending ends of said secondary blades having an axial location spaced above the lower sharp ends of said primary blades; a flat starter portion extending axially downward from the angular sharp ends of and in the general plane of the coplanar primary blades; and said starter portion having a curved sharp lower end.

BRIEF DESCRIPTION OF THE DRAWINGS

A preferred embodiment of the invention—illustrative of the best mode in which Applicant has contemplated applying the principles—is set forth in the following description and shown in the drawings and is particularly and distinctly pointed out and set forth in the appended claims.

Similar numerals refer to similar parts throughout the various figures of the drawings.

DESCRIPTION OF THE PREFERRED EMBODIMENT

Figure 4:
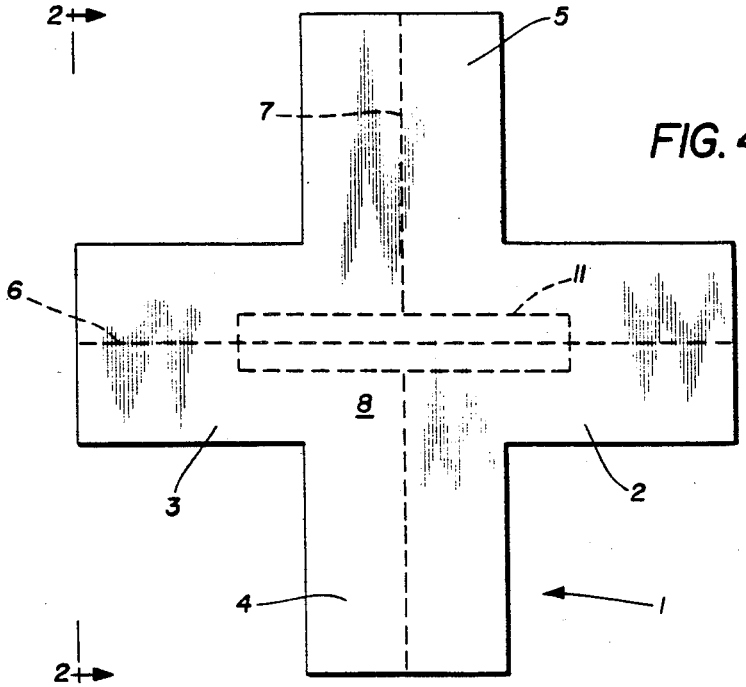
FIG. 4 is a top plan view looking in the direction of the arrows 4—4, FIG. 3.

The improved firewood quartering splitter wedge or tool is indicated generally at 1 and has a body that is generally cross-shaped in cross section or looking down at the top of the tool as shown in FIG. 4. This cross-shape is formed by four tapered wedge blades 2, 3, 4 and 5.

The wedge blades 2 and 3 are defined herein as primary coplanar wedge blades, while the wedge blades 4 and 5 are defined herein as secondary coplanar wedge blades. The dotted line 6 in FIG. 4 indicates the median plane of the primary tapered wedge blades 2 and 3, while the dotted line 7 indicates the median plane of the secondary tapered wedge blades 4 and 5.

The four wedge blades 2, 3, 4 and 5 are similarly tapered, and as shown the secondary wedge blades 4 and 5 are somewhat shorter from top to sharp lower ends than the primary wedge blades 2 and 3 as described more in detail below.

The tool 1 is formed integrally of one piece of metal, solid as shown in the drawings, preferably of hard, tough, rugged, tool-type steel to withstand repeated sledgehammer driving blows used for driving the tool into a log for quarter splitting the log. As shown in FIG. 4, the upper cross-shaped surface 8 has large area which may be struck by a sledgehammer in driving the tool 1. Thus, sledgehammer blows normally may be directed at the axial center region of the top tool surface 8 for vertical downward driving of the tool. However, blows may be directed to top blade surface portions of any one of the blades if the tool becomes tilted off vertical, and it is desired to correct such tilted position.

The integral one-piece character of the tool is of major importance since it has been found that where it is attempted to weld or otherwise join several wedge blades or parts thereof together to form the final tool construction, joints between separate portions ordinarily fail quickly after driving for short periods of time.

As shown, each blade of the tool 1 projects outward at right angles to its two adjacent blades so that the secondary blades 4 and 5 project laterally outward normal to or at right angles to the primary blades 2 and 3 from the central body portion of said primary blades.

All four of the blades 2 through 5 have lower sharp ends indicated at 9. These sharp ends 9 extend angularly outwardly downwardly from the central axial body portion of the tool 1.

The lower sharp angular ends of the secondary blades 4 and 5, above indicated as being shorter than the primary blades thus do not engage or enter the top surface of the wood log or billet being split until after the sharp edges 9 of the primary blades 2 and 3 have initially entered the wood for reasons described below.

Figure 1:
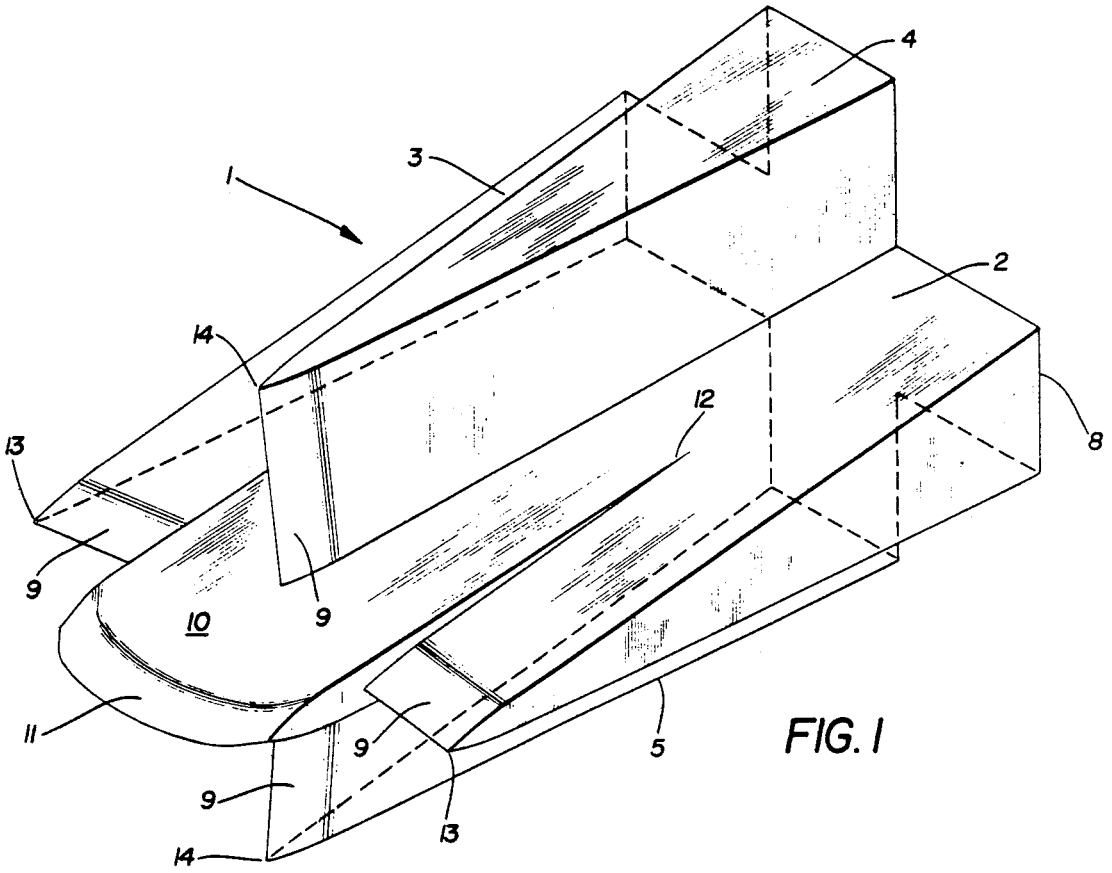
FIG. 1 is a perspective view of the new tool for quarter splitting wood logs constructed in accordance with the invention.
Figure 3:
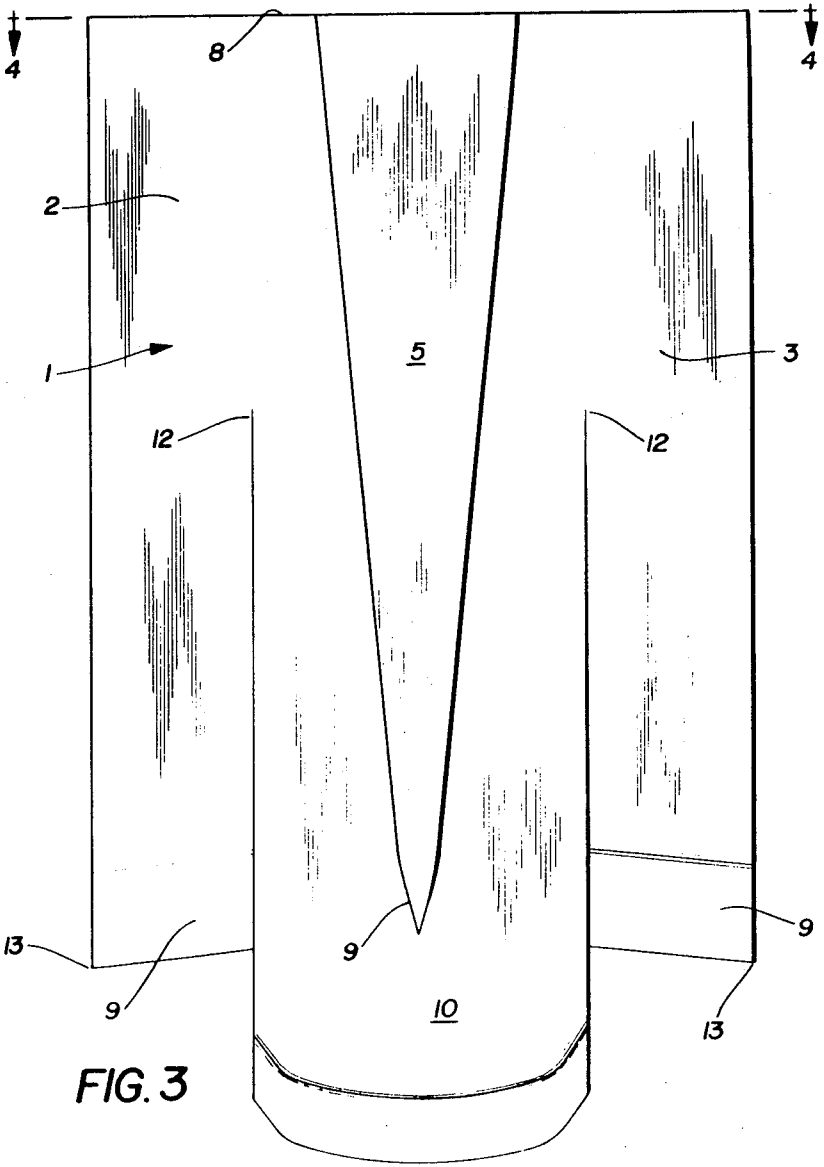
FIG. 3 is an elevation looking in the direction of the arrows 3—3, FIG. 2.
Figure 2:
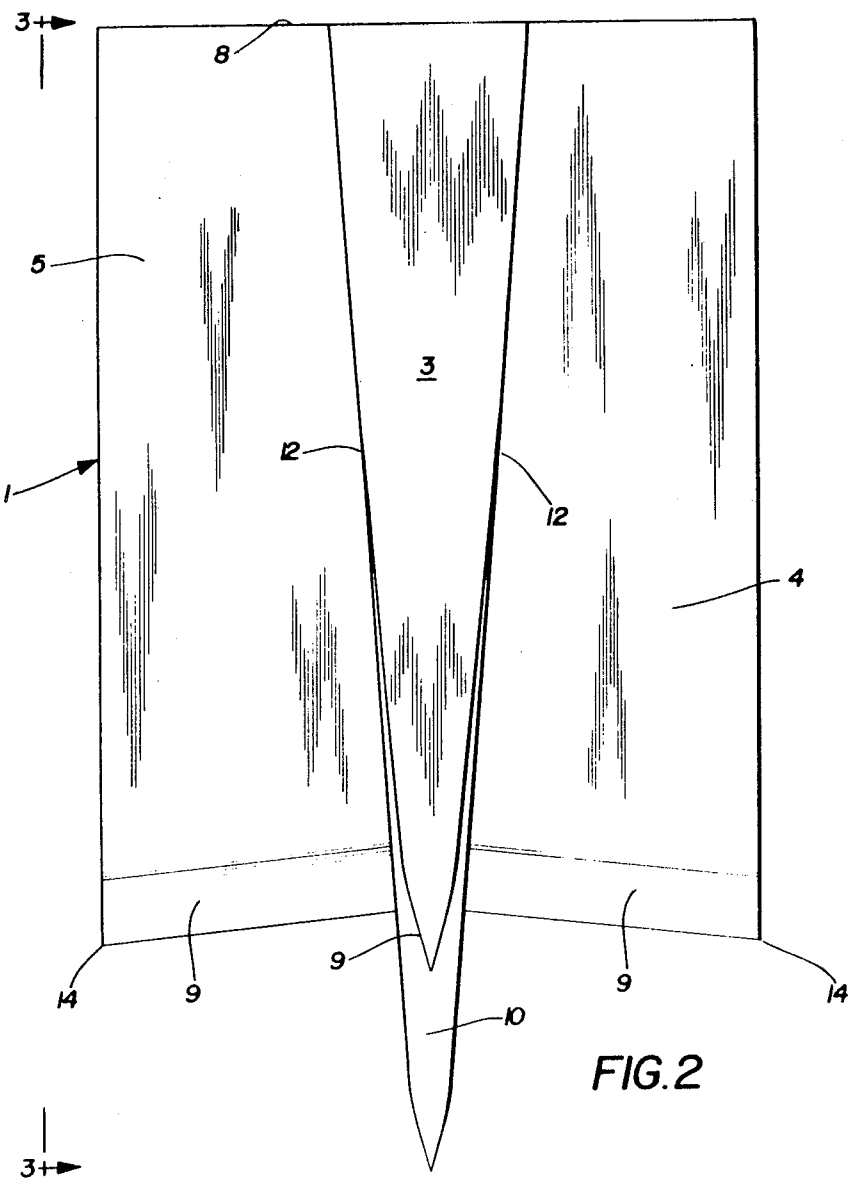
FIG. 2 is a side elevation looking in the direction of the arrows 2—2, FIG. 4.

The tool is provided with a flat starter portion 10 having a curved, sharp, wide lower end 11 of uniform width best shown in FIGS. 1 and 3. The starter portion 10 projects downward from and is connected with the primary blades 2 and 4 and extends flatwise in the median plane 6 of the blades 2 and 4 as indicated by the dotted outline of the starter portion 11 in FIG. 4. Referring particularly to FIG. 1, the flat starter portion 10 extends upward of and merges at 12 into the tapered surfaces of the primary blades 2 and 3.

It has been discovered that the relatively wide flat starter portion 10, approximately half the total width of the coplanar primary blades 2 and 3, may be readily driven into an end of a log being split until the corner points 13 of the sharp ends of the blades 2 and 3 engage the log and commence entry, and in so doing tend to steady the tool 1 vertically as driving continues until the sharp outer corners 14 of the secondary blades 4 and 5 engage the log and then enter the same during continued driving while the previously entered portions of the tool continue entry and splitting.

I have discovered that this successive entry of the starter portion 10, the primary blades 2 and 3 and then the secondary blades 4 and 5, is vital to the easy and successful quarter splitting of a log with a single cross-shaped wedge tool.

The wedge taper of the blades 2, 3, 4 and 5 should not be too narrow so that the tool tends to stick when driven making the splitting difficult. On the other hand the taper should not be too steep. I have found the preferred taper is about one and one-half inches wide at the top of each blade tapering upward from the sharp lower end for a blade length of approximately seven to seven and one-quarter or more inches.

Further, the starter portion 10 preferably should be about one-half the total width of the coplanar blades 2 and 3. For example, the starter portion may be two and one-half inches wide where the total width of the coplanar primary or secondary blades is five inches. The starter portion 10 preferably projects downward from the lower sharp ends of the primary blades 2 and 3 approximately one and one-half inches.

The taper of the sharp edges of the blades outward, downward from the axis of the tool preferably is at least one-quarter of an inch in two and one-half inches, while the axial spacing of the sharp edges of the secondary blades above the sharp edges of the primary blades is at least one-quarter of an inch.

Accordingly, the described integral metal quartering splitter wedge tool of the invention has the unique characteristics set forth and provides a tool that may be used to reliably, safely, effectively and efficiently quarter wood logs, billets, and the like, in one driving operation at the completion of which substantially similar quarters drop four ways from their standing on end location.

In the foregoing description, certain terms have been used for brevity, clearness and understanding but no unnecessary limitations are to be implied therefrom beyond the requirements of the prior art because such terms are used for descriptive purposes and are intended to be broadly construed.

Moreover, the description and illustration of the invention is by way of example, and the scope of the invention is not limited to the exact details shown or described.

Having now described the features, principles and cooperative relationships of the new structures, and the advantageous, new and useful results obtained, the new structures, components, elements, arrangements, combinations and relationships are set forth in the appended claims.

I claim:

1. A metal tool for quarter splitting wood logs, billets and the like, of the type having a body cross-shaped in cross section formed by four tapered wedge blades joined at an axially extending central body portion from which each blade projects outward at right angles to its two adjacent blades, wherein the improvement comprises:

(a) a solid integral metal body having four similarly tapered wedge blades;

(b) said four wedge blades including two coplanar primary wedge blades and two coplanar secondary wedge blades with said secondary wedge blades projecting normally outward from the sides of said coplanar primary blades;

(c) all of said wedge blades having lower sharp ends extending angularly outwardly downwardly from said central axial body portion;

(d) the lower sharp angularly extending ends of said secondary blades having an axial location spaced above the lower sharp angularly extending ends of said primary blades;

(e) a flat starter portion extending axially downward from the angular sharp ends of and in the general plane of the coplanar primary blades;

(f) said starter portion having a curved sharp lower end;

(g) said starter portion having a uniform width terminating at said curved sharp lower end; and (h) said starter portion having a width of approximately one-half of the total width of said coplanar primary blades.

* * * * *